US010066522B2

(12) United States Patent
Nishi et al.

(10) Patent No.: US 10,066,522 B2
(45) Date of Patent: Sep. 4, 2018

(54) ENGINE

(71) Applicant: YAMAHA MOTOR POWER PRODUCTS KABUSHIKI KAISHA, Kakegawa-shi, Shizuoka (JP)

(72) Inventors: Kengo Nishi, Shizuoka (JP); Nobuo Jinnohara, Shizuoka (JP)

(73) Assignee: YAMAHA MOTOR POWER PRODUCTS KABUSHIKI KAISHA, Shizuoka (JP)

( * ) Notice: Subject to any disclaimer, the term of this patent is extended or adjusted under 35 U.S.C. 154(b) by 100 days.

(21) Appl. No.: 15/306,148

(22) PCT Filed: Apr. 24, 2015

(86) PCT No.: PCT/JP2015/062608

§ 371 (c)(1),
(2) Date: Oct. 24, 2016

(87) PCT Pub. No.: WO2015/163471

PCT Pub. Date: Oct. 29, 2015

(65) Prior Publication Data

US 2017/0044941 A1 Feb. 16, 2017

(30) Foreign Application Priority Data

Apr. 25, 2014 (JP) ..... 2014-091964

(51) Int. Cl.
*F01M 11/00* (2006.01)
*F02B 67/00* (2006.01)
(Continued)

(52) U.S. Cl.
CPC ..... *F01M 11/0004* (2013.01); *F01M 1/02* (2013.01); *F01M 1/10* (2013.01);
(Continued)

(58) Field of Classification Search
CPC ..... F01M 11/0004; F01M 1/02; F01M 1/10; F02B 67/00; F02B 75/22
See application file for complete search history.

(56) References Cited

U.S. PATENT DOCUMENTS 2,346,148 A 4/1944 Bosma
4,828,519 A 5/1989 Watanabe
(Continued)

FOREIGN PATENT DOCUMENTS

| | | | |
|---|---|---|---|
| CN | 101644188 A | * | 2/2010 |
| EP | 1 233 153 A1 | | 8/2002 |
| JP | 4-11438 B2 | | 2/1992 |
| JP | 7-174010 A | | 7/1995 |
| JP | 11-343827 A | | 12/1999 |
| JP | 2002-242634 A | | 8/2002 |
| JP | 2004-150413 A | | 5/2004 |
| JP | 2004-278453 A | | 10/2004 |
| JP | 2008-274837 A | | 11/2008 |

OTHER PUBLICATIONS

Official Communication issued in International Patent Application No. PCT/JP2015/062608, dated Oct. 6, 2015.

*Primary Examiner* — Kevin A Lathers
(74) *Attorney, Agent, or Firm* — Keating and Bennett, LLP

(57) ABSTRACT

An engine includes a crank shaft inside a crankcase and an oil pan and penetrates the crankcase and the oil pan in an up-down direction. An oil pump and an oil strainer are provided inside the oil pan. The oil pump is coaxial with the crank shaft and is driven by the crank shaft. The crank shaft includes a first region and a second region respectively supported pivotably by a plate-shaped support and the crankcase. The support is provided in the crankcase such that both surfaces of the support are covered by the crankcase and the oil pan and allows communication between the crankcase and the oil pan.

8 Claims, 20 Drawing Sheets

(51) Int. Cl.

| | |
|---|---|
| ***F01M 1/02*** | (2006.01) |
| ***F02B 75/22*** | (2006.01) |
| ***F01M 1/10*** | (2006.01) |
| ***F02B 75/00*** | (2006.01) |
| *F02F 7/00* | (2006.01) |
| *F01M 13/00* | (2006.01) |
| *F01M 13/04* | (2006.01) |

(52) U.S. Cl.

CPC ..... *F02B 67/00* (2013.01); *F02B 75/007* (2013.01); *F02B 75/22* (2013.01); *F01M 13/0011* (2013.01); *F01M 13/04* (2013.01); *F01M 2001/0269* (2013.01); *F01M 2001/1028* (2013.01); *F01M 2011/005* (2013.01); *F02F 7/0053* (2013.01)

(56) References Cited

U.S. PATENT DOCUMENTS

| | | | | |
|---|---|---|---|---|
| 5,113,818 | A * | 5/1992 | Bonde ..... | F01M 11/06 123/195 C |
| 5,876,188 | A | 3/1999 | Okamoto | |
| 7,201,132 | B2 * | 4/2007 | Miyake ..... | F01M 1/04 123/195 HC |
| 2002/0121261 | A1 | 9/2002 | Shinoda et al. | |
| 2004/0134458 | A1 | 7/2004 | Chiba et al. | |

* cited by examiner

ENGINE

BACKGROUND OF THE INVENTION

1. Field of the Invention

The present invention relates to engines, and more specifically to vertical engines used in machinery such as mowing equipment.

2. Description of the Related Art

JP-A 2002-242634 discloses an example of an engine of the above type. JP-A 2002-242634 discloses a vertical engine in which a crank shaft axial direction corresponds to an up-down direction, with an oil pan supporting the crank shaft.

In the engine disclosed in JP-A 2002-242634, there is no lid member provided in an upper surface of the oil pan. Therefore, when the engine is tilted, there is a case where, depending on the angle, there is no lubricant oil near a suction inlet of an oil strainer inside the oil pan. If this situation continues, lubricant oil cannot be supplied from the oil strainer to an oil pump, possibly leading to a problem that lubricant oil cannot be circulated inside the engine.

Also, since the crank shaft is supported by the oil pan which is exposed to the outside, vibratory noise from the crank shaft easily leaks to the outside.

SUMMARY OF THE INVENTION

Preferred embodiments of the present invention provide an engine that is able to reliably supply lubricant oil from an oil strainer inside an oil pan to an oil pump while reducing vibratory noise from the crank shaft.

According to a preferred embodiment of the present invention, an engine includes a crankcase including a downward opening; an oil pan provided below the crankcase and including an upward opening; a crank shaft provided inside the crankcase and the oil pan such that a crank shaft axis extends in an up-down direction and the crank shaft penetrates the crankcase and the oil pan; an oil pump coaxial with the crank shaft and driven by the crank shaft; an oil strainer provided inside the oil pan; and a plate-shaped support pivotably supporting a first region of the crank shaft. With the above arrangement, the support is disposed in at least one of the crankcase and the oil pan such that both surfaces of the support are covered by the crankcase and the oil pan and allows communication between the crankcase and the oil pan.

According to a preferred embodiment of the present invention, the support is preferably plate-shaped and therefore, defines and functions as a lid member for the oil pan, and prevents lubricant oil inside the oil pan from moving upward beyond the support. Even if the engine is tilted, for example, causing the lubricant oil to move from below to above the support, the lubricant oil which has moved upward beyond the support returns to the oil pan since the crankcase and the oil pan communicate with each other. Lubricant oil which has circulated inside the engine and flows down from a higher position than the support also returns to the oil pan. Therefore, it is possible to cause the lubricant oil to be near the oil strainer inside the oil pan, and to stably supply lubricant oil from the oil strainer to the oil pump. Also, the support which supports the crank shaft has both of its surfaces covered by the crankcase and the oil pan. This makes it possible to reduce noise, which is caused by vibrations from the crank shaft, from escaping to the outside.

Preferably, the engine further includes a cam shaft parallel or substantially parallel to the crank shaft and located inside the crankcase. With this arrangement, the support pivotably supports the crank shaft and the cam shaft. In this case, it is possible to improve the accuracy in the center-to-center distance between the crank shaft and the cam shaft since the crank shaft and the cam shaft are supported by one support.

Further preferably, the engine further includes a governor shaft parallel or substantially parallel to the crank shaft and located inside the crankcase. With this arrangement, the support supports the crank shaft, the cam shaft and the governor shaft. In this case, it is possible to improve the accuracy in the center-to-center distance between the crank shaft, the cam shaft and the governor shaft since the crank shaft, the cam shaft and the governor shaft are supported by one support.

Further, preferably, the oil pump is disposed inside the oil pan. In this case, a height difference between the oil pump and the oil strainer is small, making it possible to decrease suction resistance in the oil pump.

Preferably, the support includes a perimeter edge region including mounts attached to at least one of the crankcase and the oil pan to mount the support inside the crankcase and the oil pan. In this case, the support is incorporated inside the crankcase and the oil pan, i.e., is not exposed outside of the crankcase or the oil pan. This makes it possible to confine noise, which is caused by vibrations conducted from the crank shaft to the support, within the crankcase and the oil pan and to further decrease noise.

Further preferably, the mounts are attached to the crankcase, and the crankcase pivotably supports a second region of the crank shaft. In this case, the crank shaft is pivotably supported by the support attached to the crankcase, and by the crankcase. This makes it possible to decrease vibrations of the crank shaft than in an arrangement where the support is attached to the oil pan.

Further, preferably, the support includes ribs which are provided at an axial center of the crank shaft and extend radially toward the mounts. In this case, it is possible to improve the strength of the support, making it easy to dissipate loads applied from the crank shaft to the support, to the crankcase or the oil pan along the ribs.

Preferably, the engine further includes a ball bearing disposed between the support and an outer surface of the crank shaft. In this case, by supporting the crank shaft with the ball bearing, the arrangement provides an appropriate solution to receive not only radial loads applied to the crank shaft but also thrust loads applied thereto.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
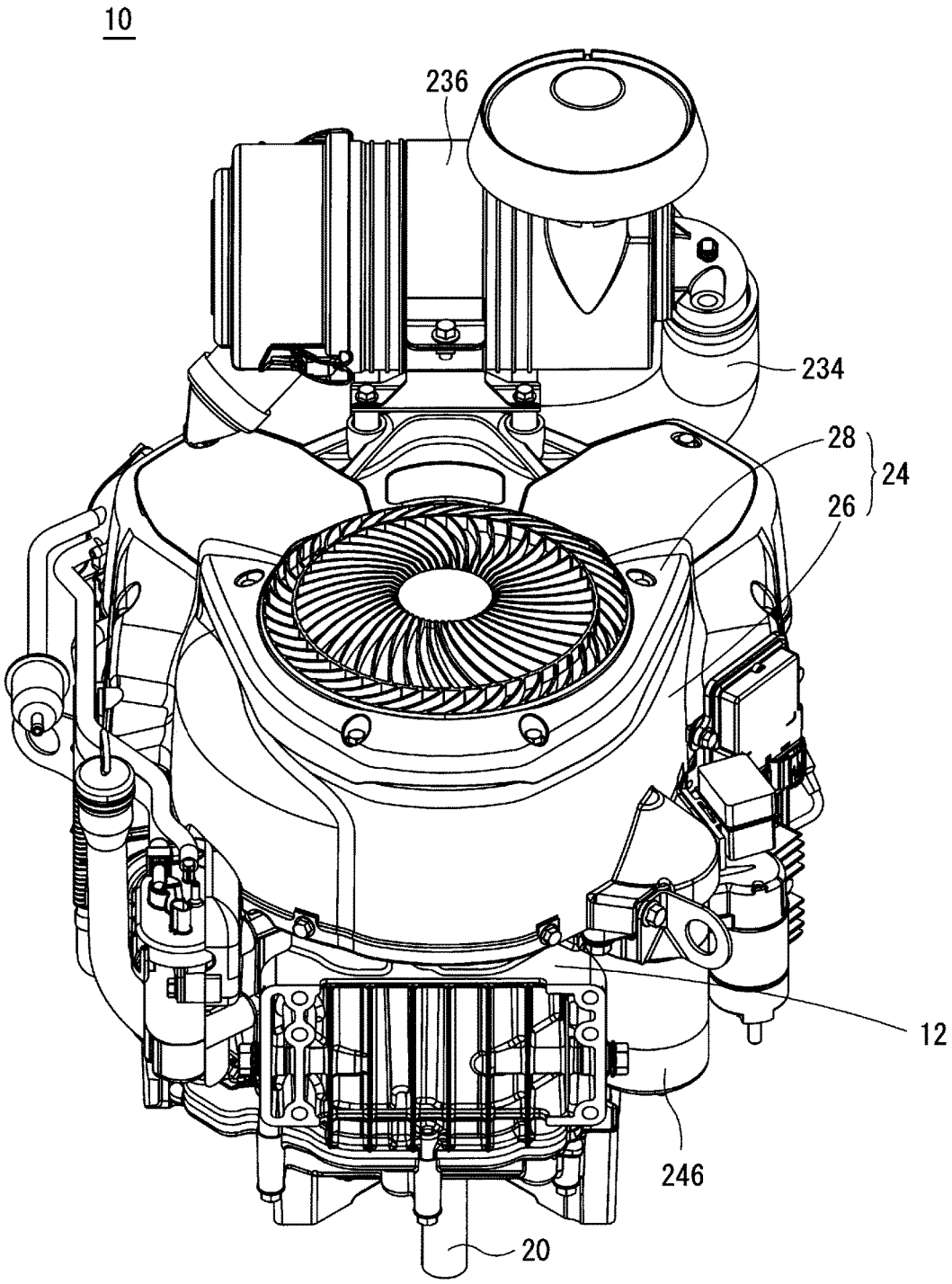
FIG. 1 is a top perspective view of an engine according to a preferred embodiment of the present invention.
Figure 2:
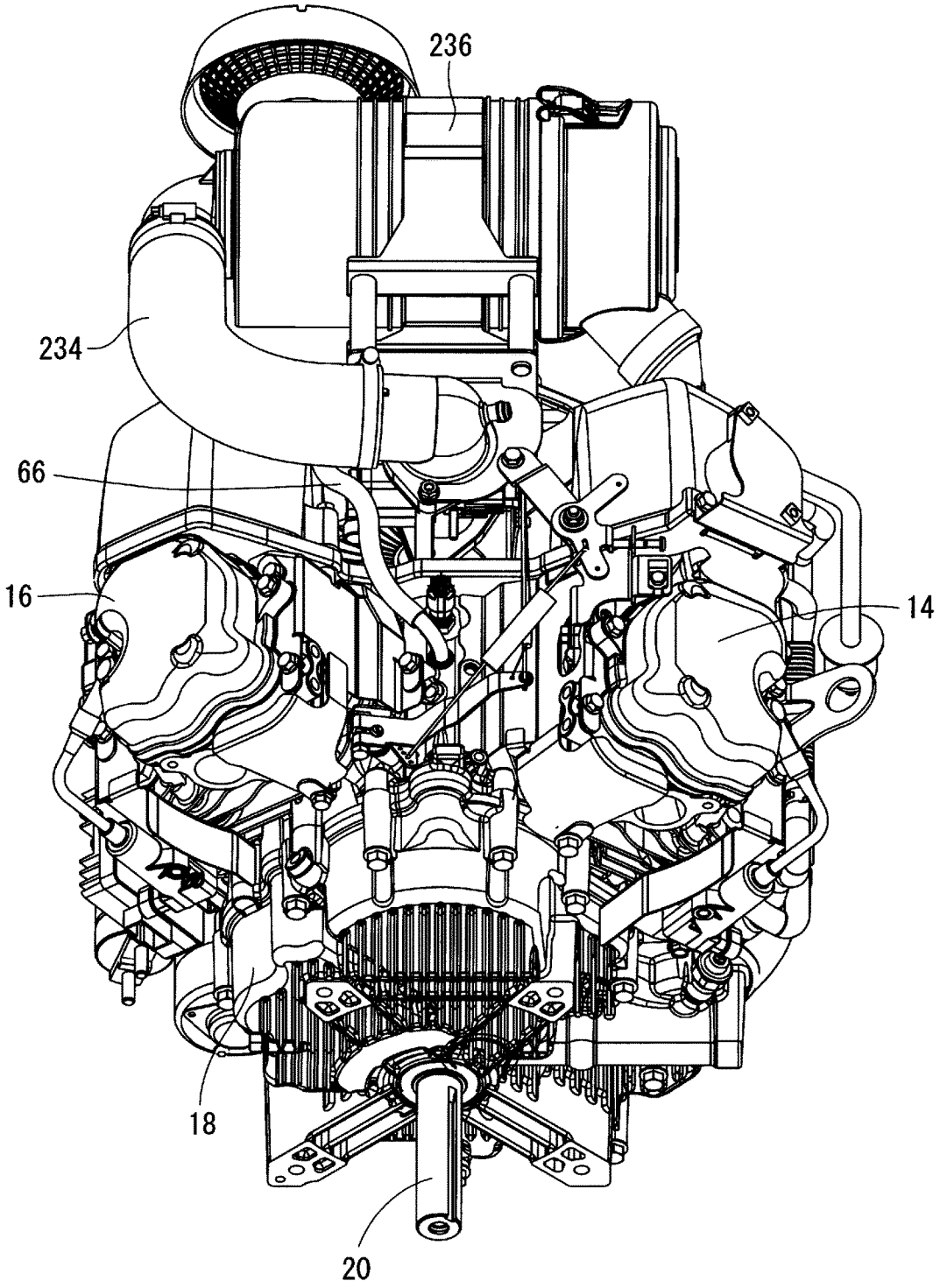
FIG. 2 is a bottom perspective view of the engine according to a preferred embodiment of the present invention.
Figure 3:
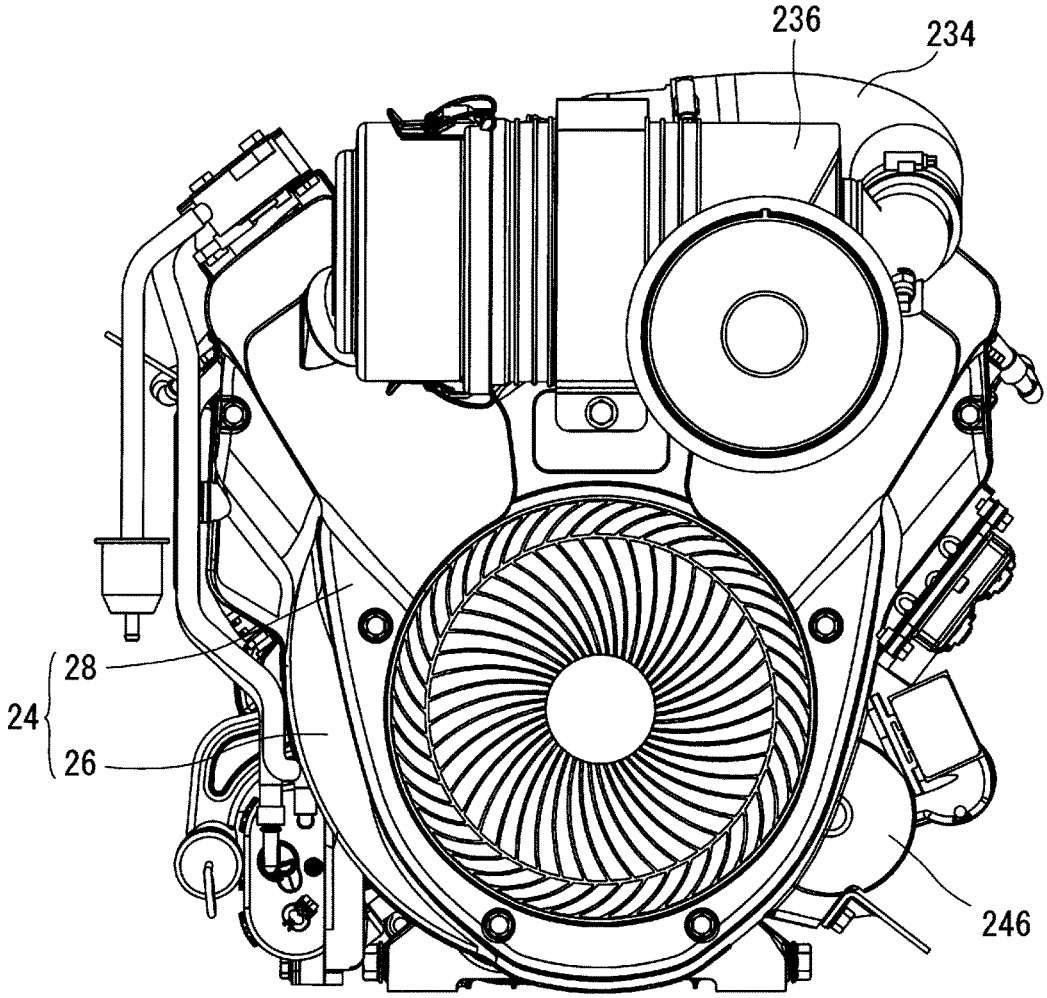
FIG. 3 is a plan view of the engine according to a preferred embodiment of the present invention.
Figure 4:
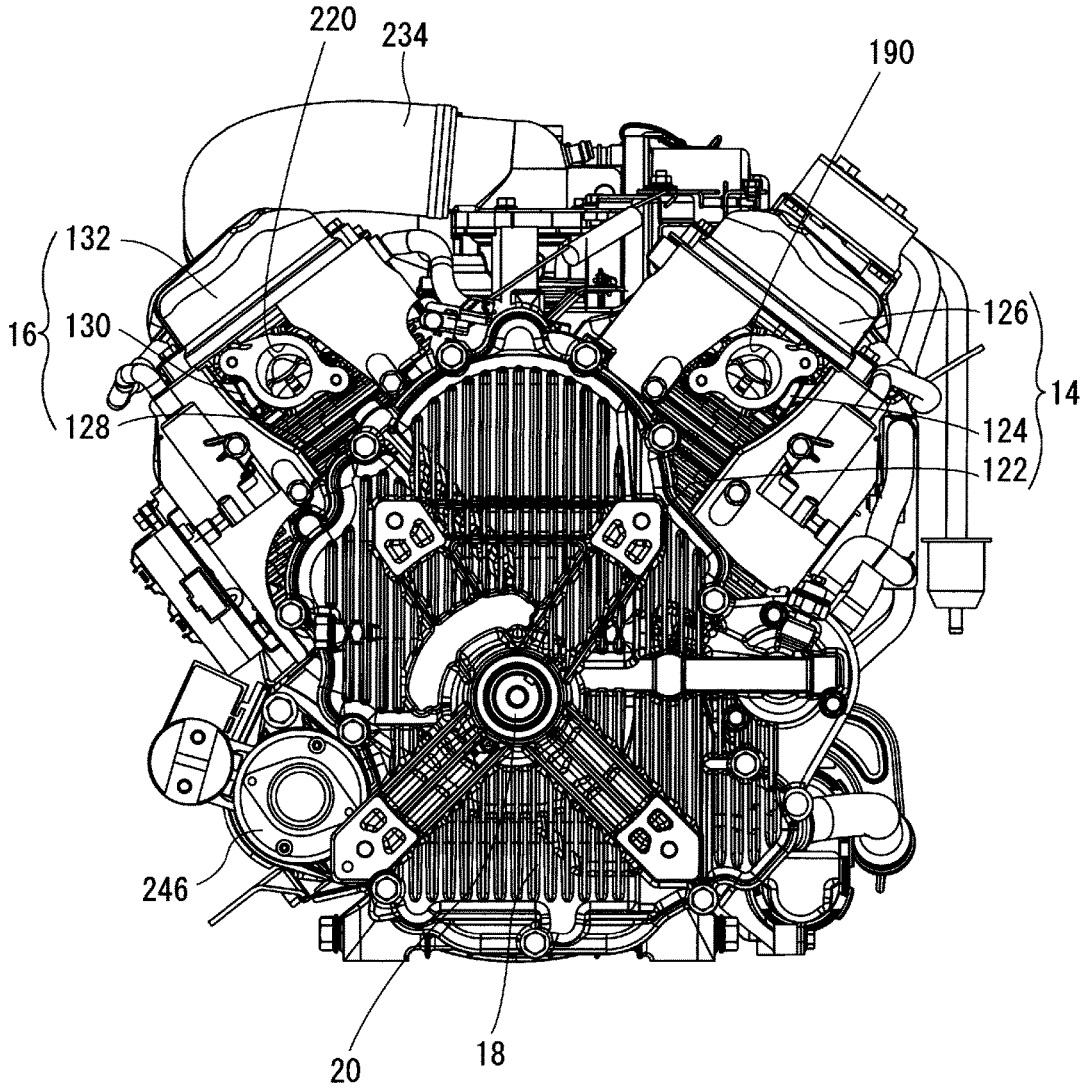
FIG. 4 is a bottom view of the engine according to a preferred embodiment of the present invention.
Figure 5:
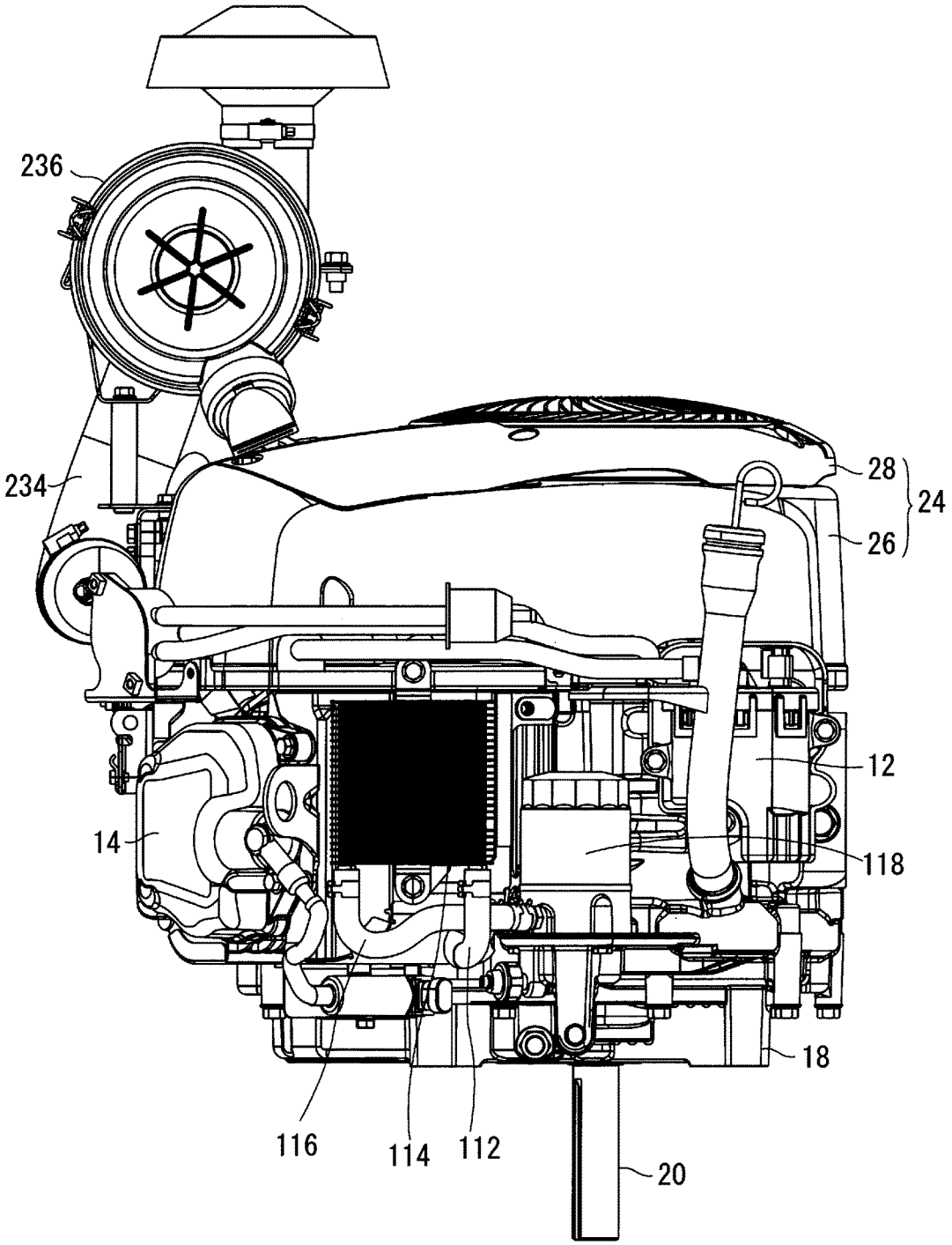
FIG. 5 is a side view (taken from the left) of the engine according to a preferred embodiment of the present invention.
Figure 6:
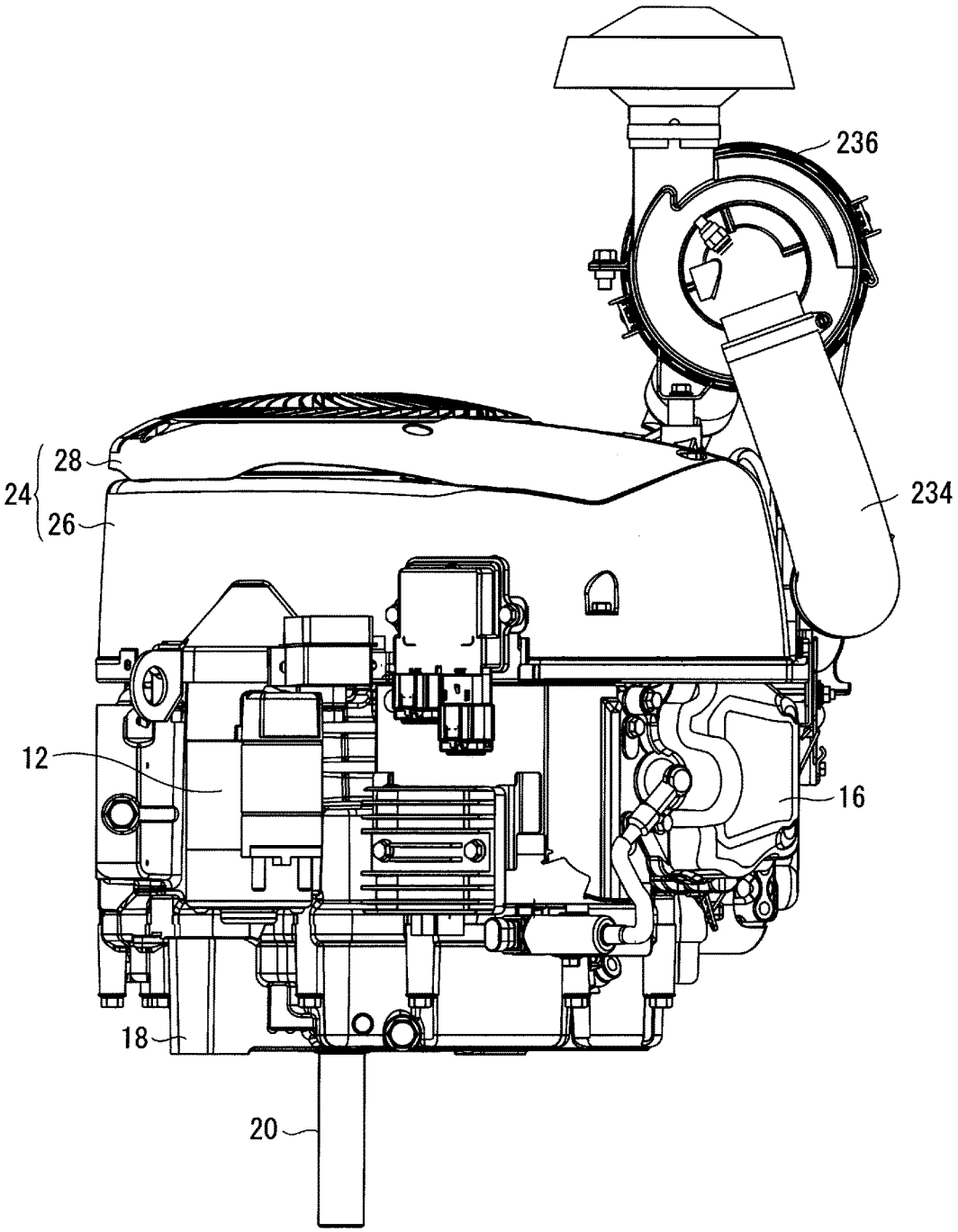
FIG. 6 is a side view (taken from the right) of the engine according to a preferred embodiment of the present invention.
Figure 7:
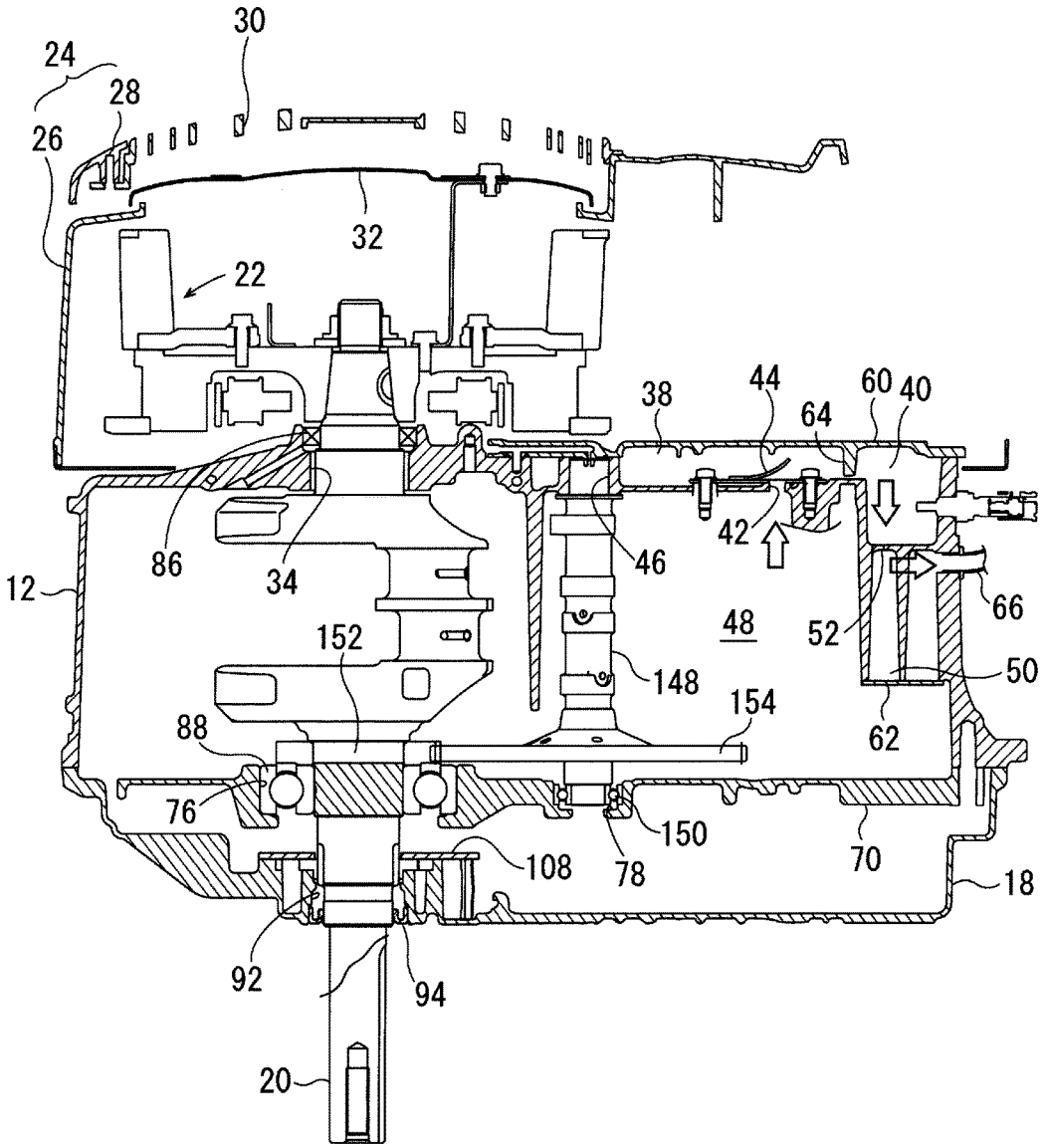
FIG. 7 is a vertical sectional view (taken along line A-A in FIG. 8) of the engine according to a preferred embodiment of the present invention.

Referring to FIG. 1 through FIG. 6, an engine 10 according to a preferred embodiment of the present invention is, for example, a vertical, narrow-angle (less than 90 degrees), V-shaped, two-cylinder, OHV engine (Over Head Valve Engine). The engine 10 includes a crankcase 12. Two cylinders 14, 16 are arranged in a V-shape on a side surface of the crankcase 12. An oil pan 18 is provided below the crankcase 12. A crank shaft 20 is provided inside the crankcase 12 and the oil pan 18 so that its axial direction extends in an up-down direction (see FIG. 7). The crank shaft 20 penetrates the crankcase 12 and the oil pan 18 in the up-down direction. Referring to FIG. 7, above the crankcase 12, a cooling fan 22 is arranged coaxially with the crank shaft 20. The cooling fan 22 is driven by the crank shaft 20, and introduces cooling air from above the crankcase 12. A cover portion 24 covers the cylinders 14, 16, the crankcase 12, and the cooling fan 22 from above. The cover portion 24 includes a first cover 26 and a second cover 28 which is attached onto the first cover 26. The second cover 28 includes an air inlet 30 at a location facing the cooling fan 22 to introduce air from the outside. Inside the second cover 28, a grass screen 32 is provided to prevent invasion of impurities such as grass. The outside air introduced from the air inlet 30 by driving the cooling fan 22 cools the engine 10.

Figure 8:
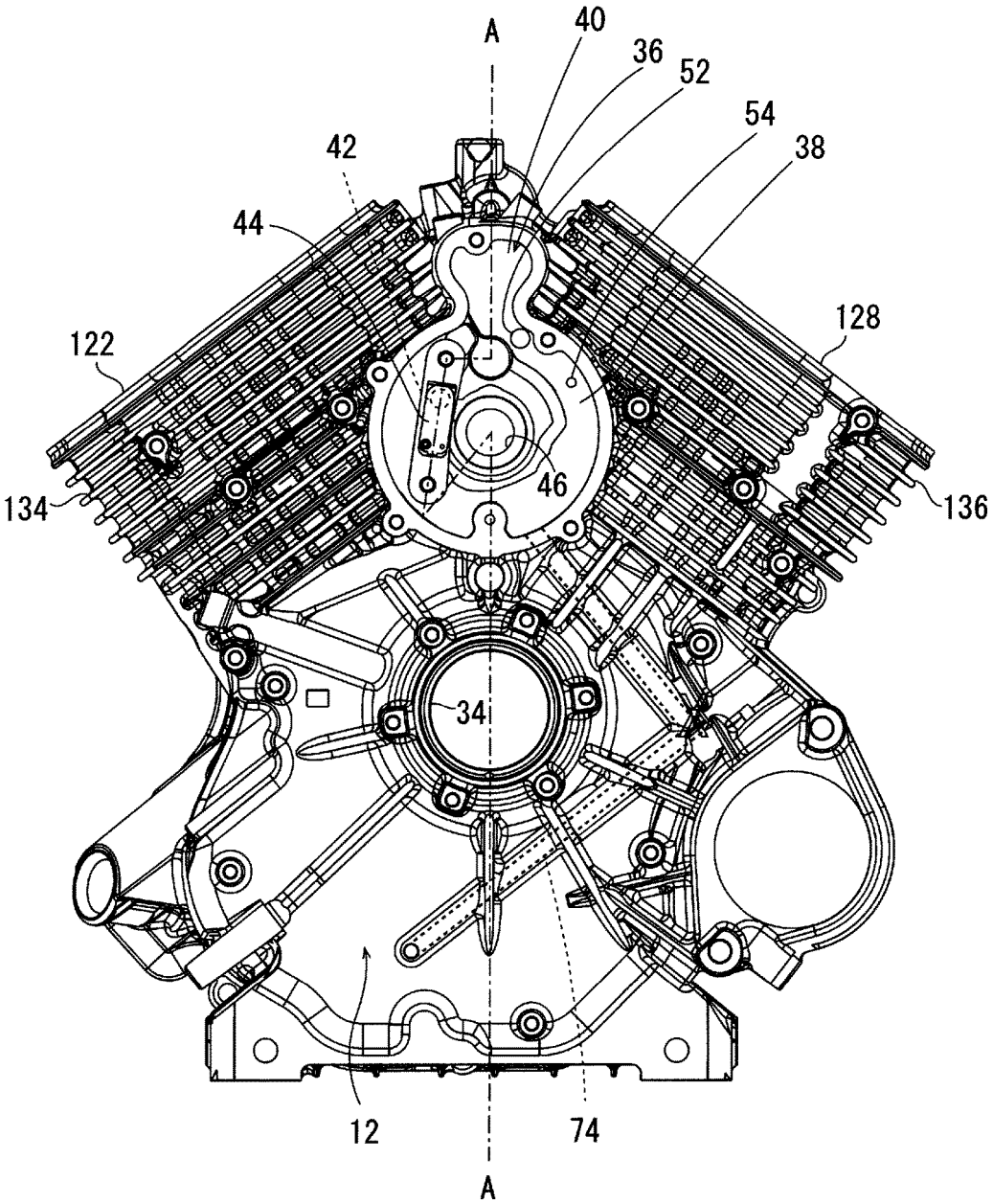
FIG. 8 is a plan view showing a crankcase and a cylinder body.
Figure 9:
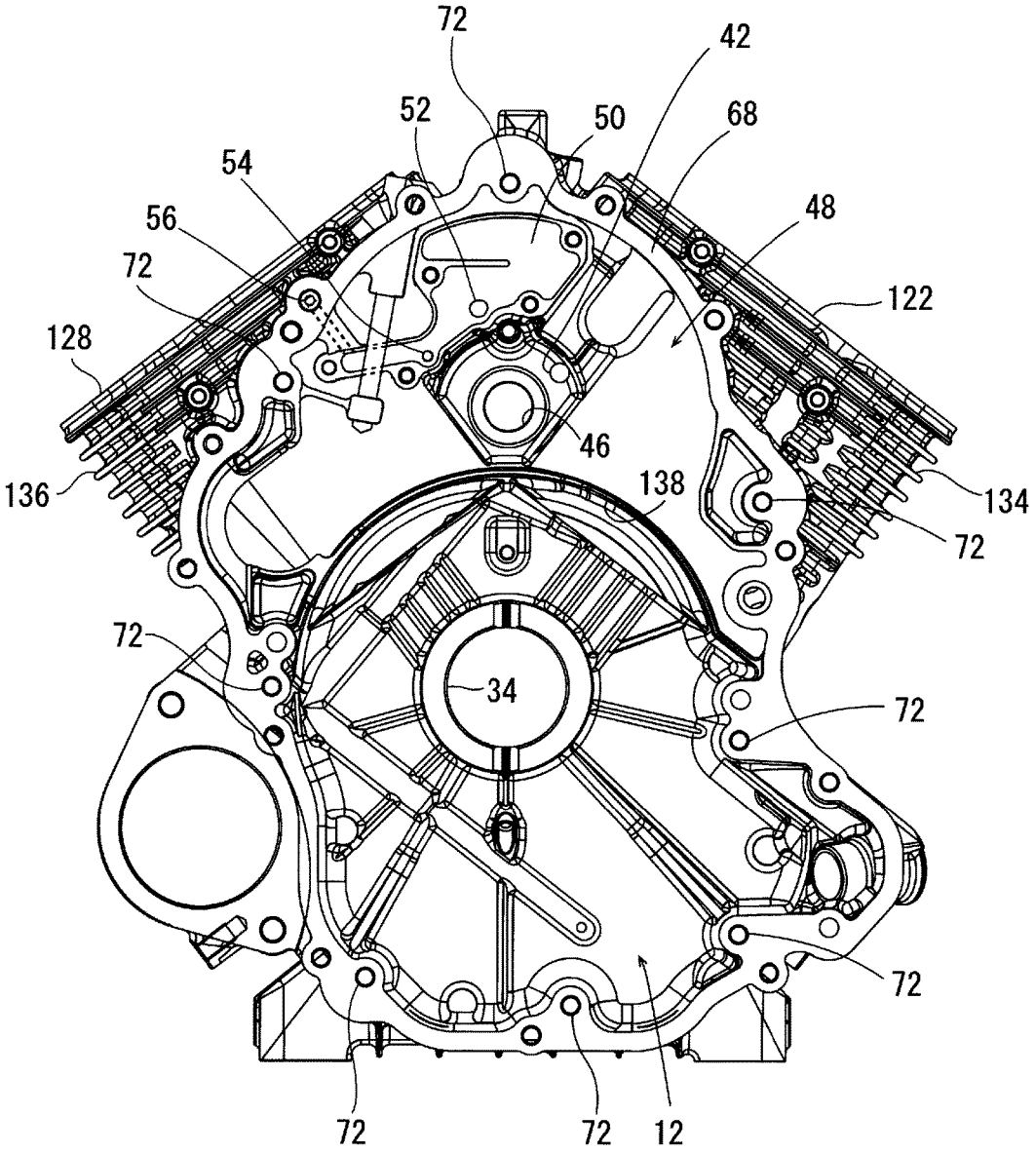
FIG. 9 is a bottom view showing the crankcase and the cylinder body.
Figure 10:
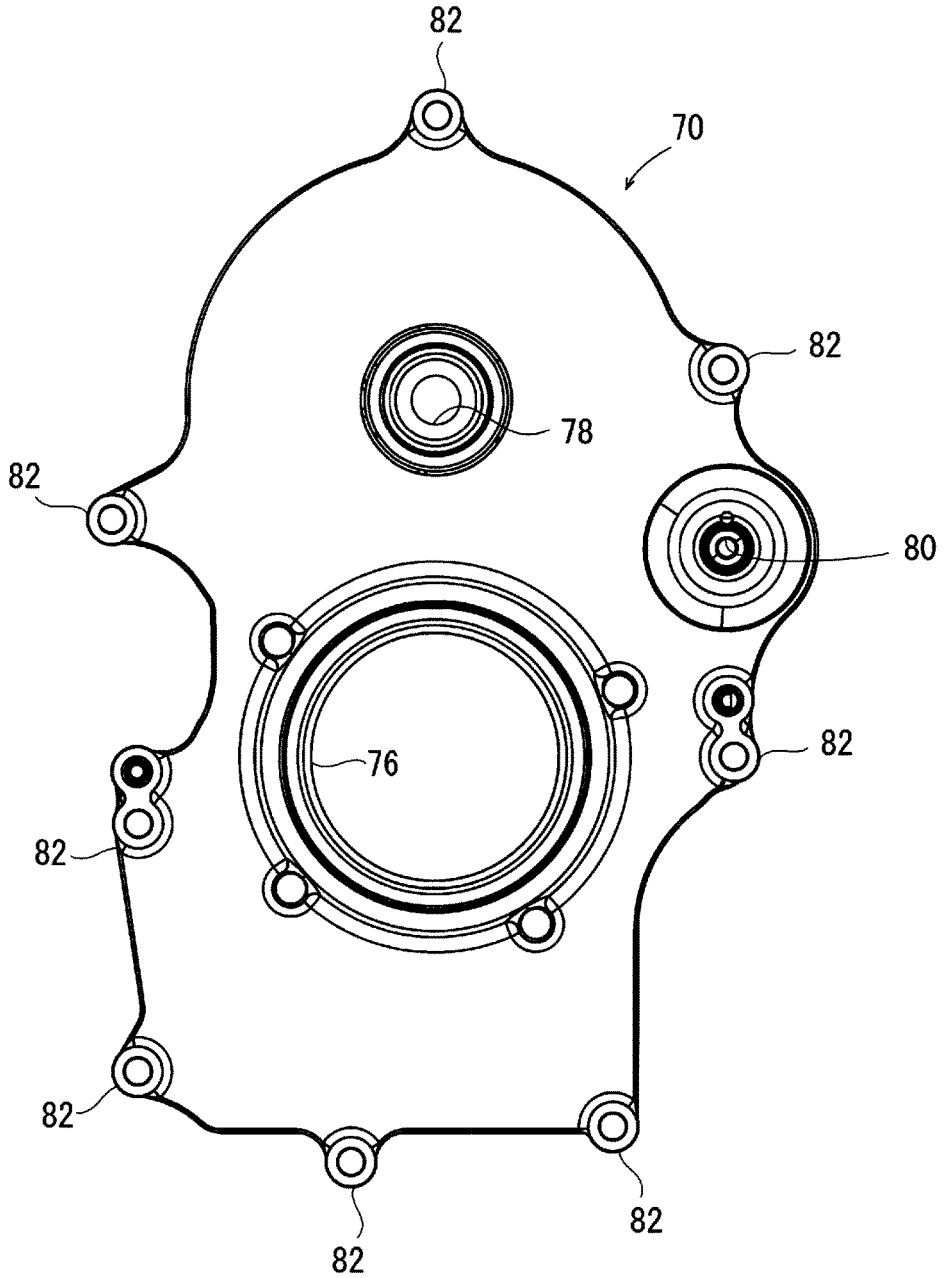
FIG. 10 is a plan view showing a support.
Figure 11:
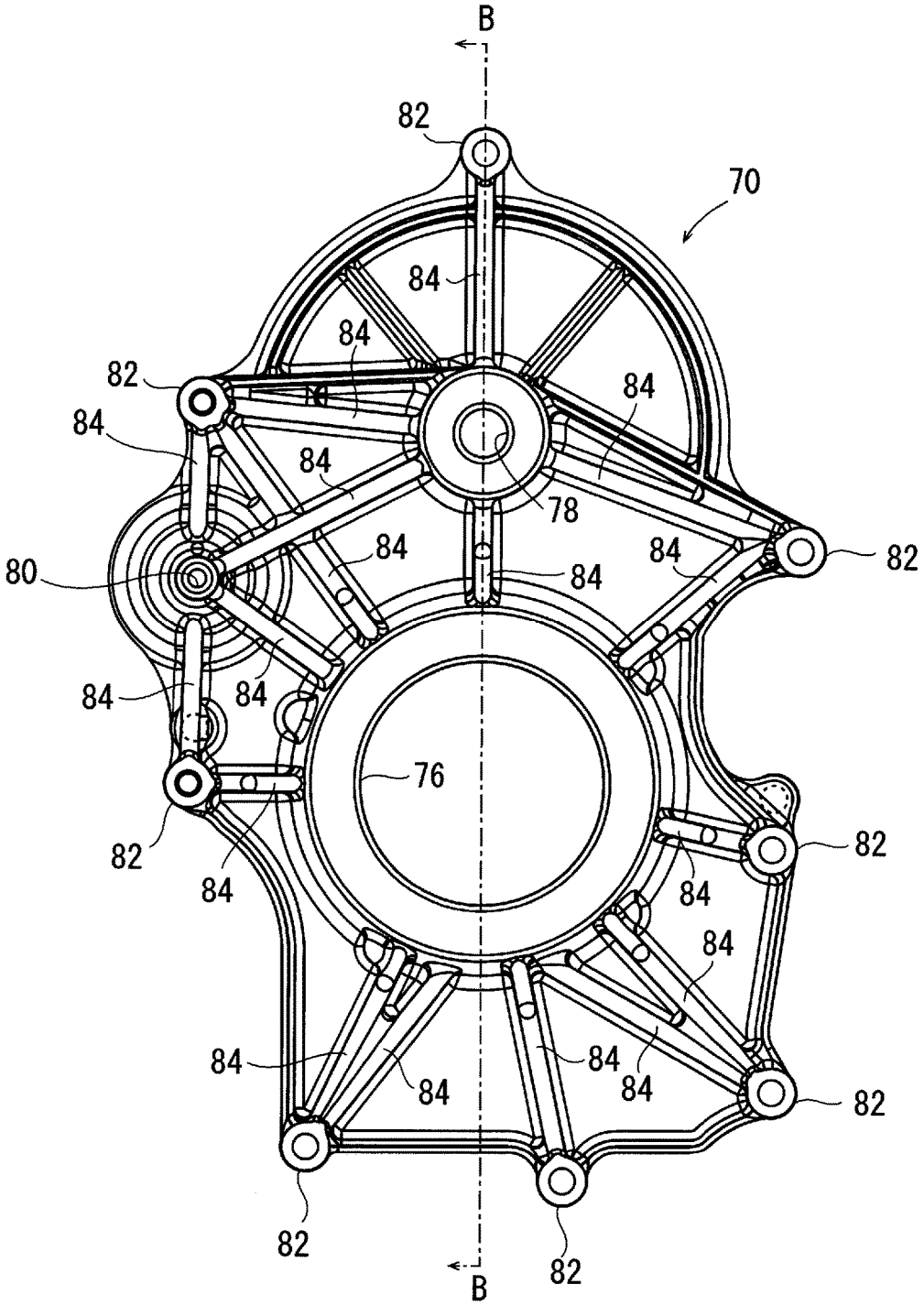
FIG. 11 is a bottom view showing the support.
Figure 12:
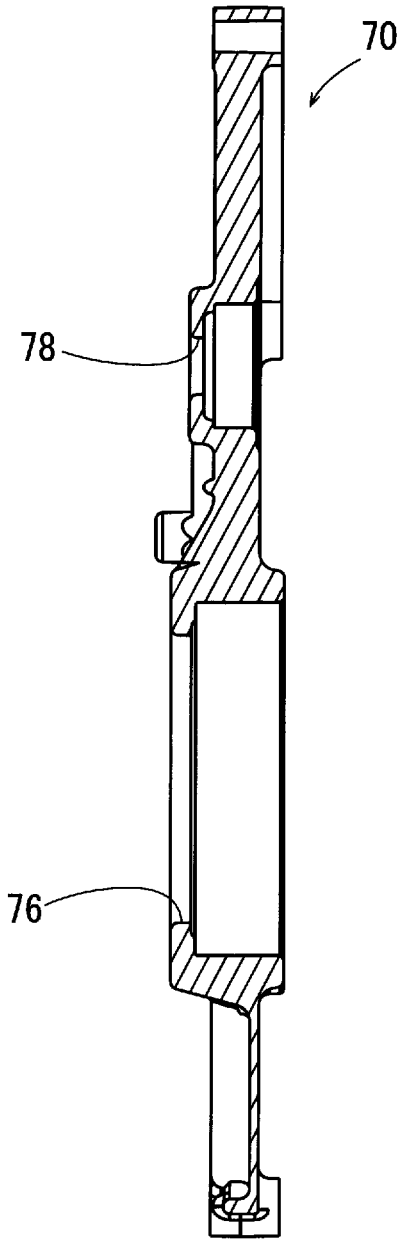
FIG. 12 is a sectional view along line B-B (see FIG. 11) showing the support.

Referring to FIG. 7 through FIG. 9, the crankcase 12 includes a through-hole 34 that is penetrated by the crank shaft 20. The crankcase 12 includes an upper surface including an upward opening, and a generally gourd-shaped recess 36. In the recess 36, there are provided a first gas/liquid separating chamber 38 and a second gas/liquid separating chamber 40. The first gas/liquid separating chamber 38 has a greater capacity than the second gas/liquid separating chamber 40. The first gas/liquid separating chamber 38 and a hollow portion 48 (which will be described below) of the crankcase 12 communicate with each other via a through-hole 42. The through-hole 42 is opened/closed by a reed valve 44 provided in the first gas/liquid separating chamber 38. In a central or substantially central region of the first gas/liquid separating chamber 38, there is provided a bearing hole 46 that receives a cam shaft 148 (which will be described below). In the crankcase 12, the hollow portion 48 includes a downward opening. The hollow portion 48 defines an oil chamber. In the hollow portion 48, a third gas/liquid separating chamber 50 is provided.

The second gas/liquid separating chamber 40 and the third gas/liquid separating chamber 50 communicate with each other via an oil return hole 52; the first gas/liquid separating chamber 38 and the third gas/liquid separating chamber 50 communicate with each other via an oil return hole 54; and the third gas/liquid separating chamber 50 and the oil pan 18 communicate with each other via an oil return channel 56 provided in the crankcase 12 and an oil return channel 58 (see FIG. 16) provided in the oil pan 18. The first gas/liquid separating chamber 38 and the second gas/liquid separating chamber 40 include a lid 60 covering their upper surfaces. The third gas/liquid separating chamber 50 includes a lid 62 on its lower surface.

The first gas/liquid separating chamber 38, the second gas/liquid separating chamber 40 and the third gas/liquid separating chamber 50 are located near and/or between the two cylinders 14, 16 (between the V banks) in the crankcase 12. The lid 60 includes a lower surface including a wall 64, which reduces gas flow from the first gas/liquid separating chamber 38 to the second gas/liquid separating chamber 40. Blowby gas from the hollow portion 48 of the crankcase 12 is separated into gas and liquid in the first gas/liquid separating chamber 38 and the second gas/liquid separating chamber 40, and further in the third gas/liquid separating chamber 50. The three gas/liquid separating chambers provided in the crankcase 12 increase separation efficiency due to the multi-stage expansion. As indicated by white arrows in FIG. 7, blowby gas is sent from the hollow portion 48, through the first gas/liquid separating chamber 38, the second gas/liquid separating chamber 40, the third gas/liquid separating chamber 50, a gas tube 66, etc., to an upstream location in an air intake system. Lubricant oil separated in the first gas/liquid separating chamber 38, the second gas/liquid separating chamber 40 and the third gas/liquid separating chamber 50 is returned from the third gas/liquid separating chamber 50, through oil return channels 56, 58, to the oil pan 18. The hollow portion 48 of the crankcase 12 is surrounded by an end edge 68, where there is provided a plurality (for example, eight in the present preferred embodiment) of screw holes 72 to attach a plate-shaped support 70.

Referring to FIG. 8, if the engine 10 is mounted horizontally, lubricant oil from the first gas/liquid separating chamber 38 is returned to the oil pan 18 via a generally V-shaped oil return channel 74. Depending on whether the engine 18 is mounted vertically or horizontally, a different oil return channel is used to return lubricant oil to the oil pan 18.

Figure 13:
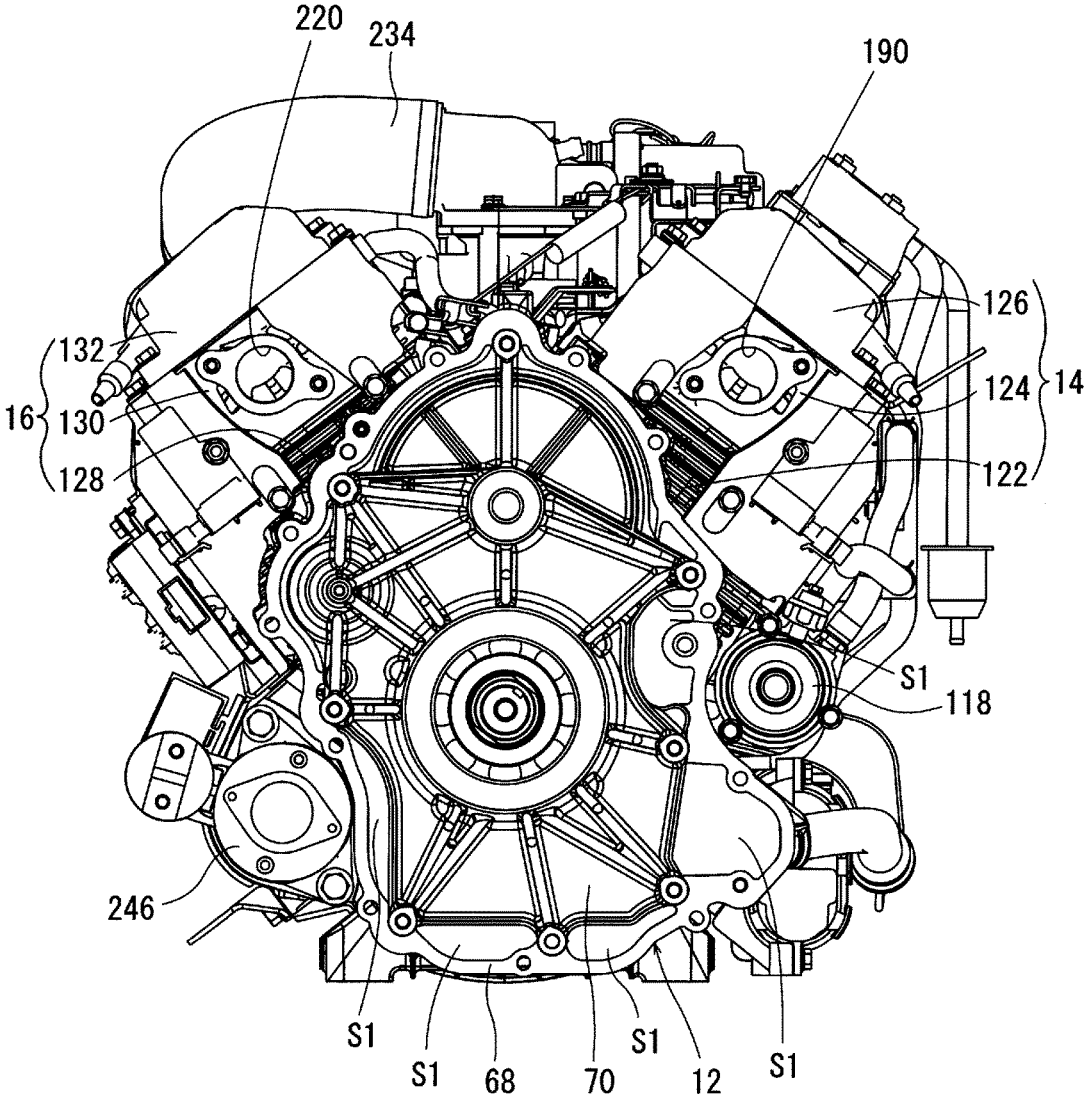
FIG. 13 is a bottom view showing the engine with an oil pan removed.
Figure 14:
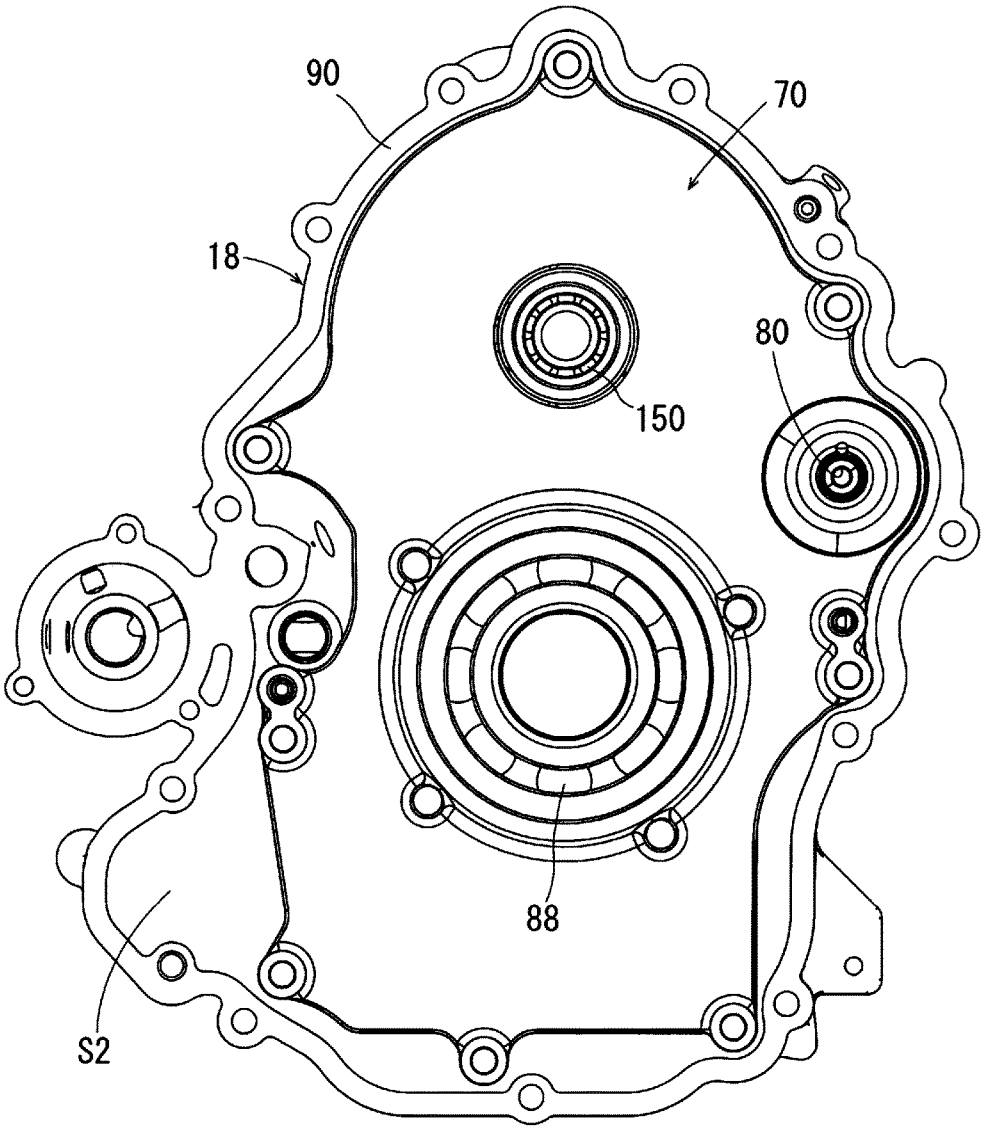
FIG. 14 is a plan view showing the oil pan and the support.

Referring to FIG. 7, FIG. 10, FIG. 11 and FIG. 12, the support 70 includes a through-hole 76 that receives the crank shaft 20, a through-hole 78 that receives the cam shaft 148 (which will be described below), and a through-hole 80 that receives a governor shaft 158 (which will be described below). Referring to FIG. 13 and FIG. 14, the support 70 has dimensions that define a plurality of gaps S1 between an outer circumference of the support 70 and the end edge 68 of the crankcase 12, and a gap S2 between the outer circumference of the support 70 and an end edge 90 of the oil pan 18. This allows communication between the crankcase 12 and the oil pan 18. The support 70 includes a perimeter edge region including a plurality (for example, eight in the present preferred embodiment) of mounts 82. In the present preferred embodiment, the mounts 82 are generally hollow and cylindrical and include thick walls. The support 70 includes a lower surface including a plurality of ribs 84. The ribs 84 extend straight and radially from an axial center (i.e., the through-hole 76) of the crank shaft 20 toward the mounts 82; extend radially from an axial center (i.e., the through-hole 78) of the cam shaft 148 toward the mounts 82; extend radially from an axial center (i.e., the through-hole 80) of the governor shaft 158 toward the mounts 82; extend from the axial center of the crank shaft 20 toward the axial center of the cam shaft 148; extend from the axial center of the crank shaft 20 toward the axial center of the governor shaft 158; and extend from the axial center of the cam shaft 148 toward the axial center of the governor shaft 158. Each of the mounts 82 in the support 70 corresponds to one of screw holes 72 in the end edge 68 of the crankcase 12, and unillustrated fasteners such as bolts, for example, are used to attach the support 70 to the crankcase 12. Then, as shown in FIG. 7, an upper region of the crank shaft 20 is supported by the crankcase 12 via a bearing 86 provided in the through-hole 34 whereas a lower region of the crank shaft 20 is supported by the support 70 via a ball bearing 88 provided in the through-hole 76. In this arrangement, the crank shaft 20 penetrates the crankcase 12 and the support 70 in an up-down direction; the support 70 pivotably supports one region of the crank shaft 20; and the crankcase 12 pivotably supports another region of the crank shaft 20.

Referring to FIG. 9 and FIG. 14, the crankcase 12 and the oil pan 18 are fastened to each other with unillustrated fasteners, with the end edge 68 of the lower open surface of the crankcase 12 and the end edge 90 of the upper open surface of the oil pan 18 in contact with each other.

Figure 15:
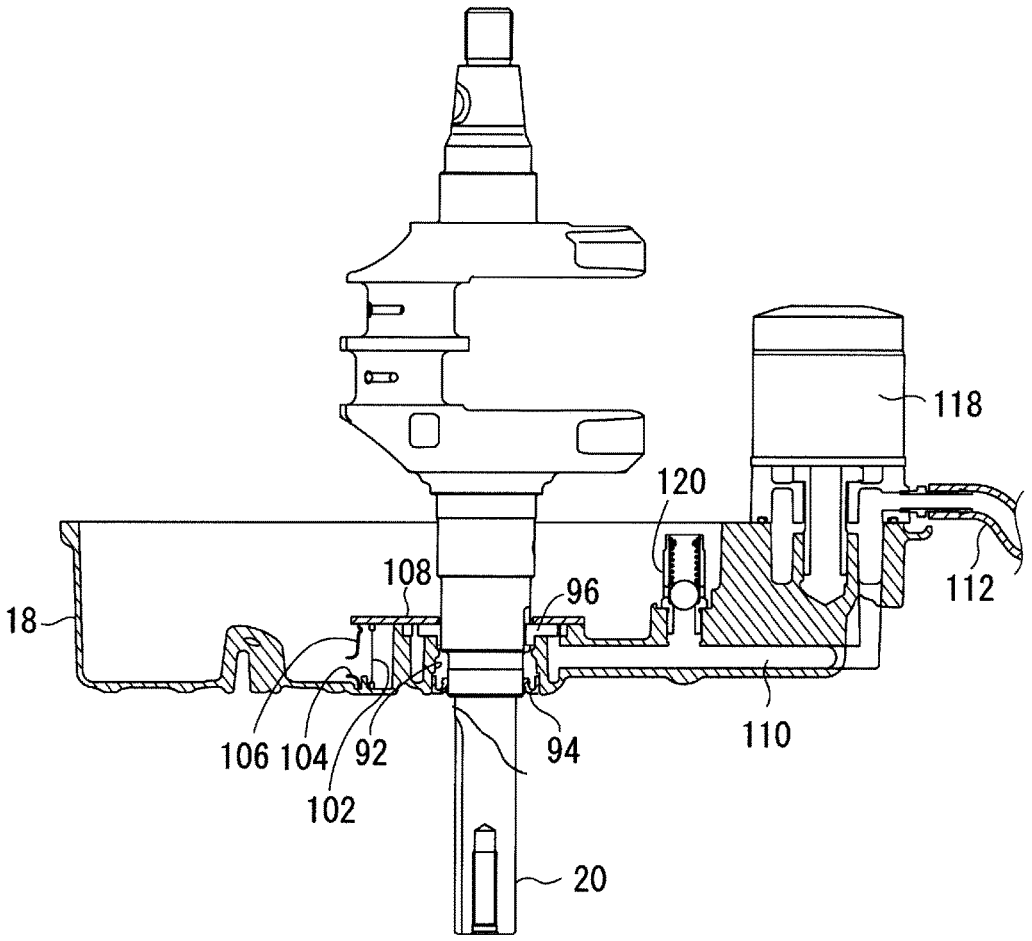
FIG. 15 is a sectional view along line C-C (see FIG. 16) showing the oil pan, a crank shaft, an oil filter, etc.
Figure 16:
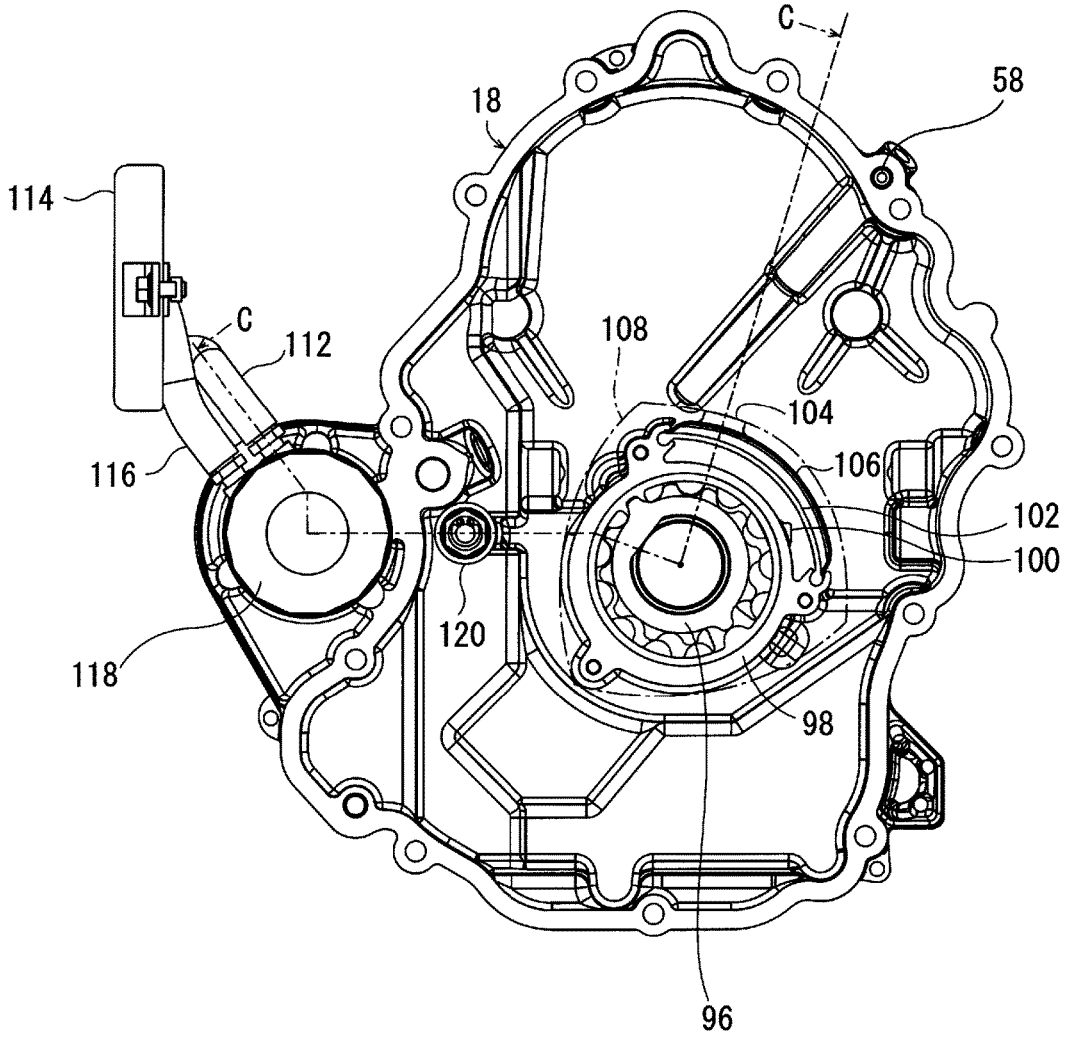
FIG. 16 is a plan view showing the oil pan and its surroundings.

Referring to FIG. 7, FIG. 15 and FIG. 16, the upward opening oil pan 18 includes a through-hole 92 that the crank shaft 20 penetrates. An oil seal 94 is located between the crank shaft 20 and the through-hole 92. Inside the oil pan 18, near the through-hole 92, there is attached an oil pump 96 at a lower position of the crank shaft 20 coaxially with the crank shaft 20. The oil pump 96 is driven as the crank shaft 20 rotates. The oil pump 96 is a trochoid pump, for example. Inside the oil pan 18, an annular member 98 surrounds the oil pump 96. The annular member 98 includes a through-hole 100. The through-hole 100 is located on an extended line of an oil path 110 (which will be described below). Inside the oil pan 18, a curved oil strainer 102 is provided on an outer side of the annular member 98, and on an outer side of the oil strainer 102, there is provided an oil strainer cover 106 which is curved and plate-shaped, and includes a suction port 104. The oil pump 96, the annular member 98, the oil strainer 102 and the oil strainer cover 106 include a cover 108 that covers their upper surfaces. Lubricant oil from the oil pump 96 is sent through the oil path 110 and an oil hose 112, and supplied to an oil cooler 114 to be cooled. The cooled lubricant oil is supplied to an oil filter 118 via an oil hose 116, filtered there, and then supplied to various portions or elements of the engine 10. The oil cooler 114 and the oil filter 118 are located outside of the oil pan 18. The oil filter 118 is disposed such that a longitudinal direction of the oil filter 118 is parallel or substantially parallel to the axial direction of the crank shaft 20. This allows for a compact structure. The oil path 110 is provided with a relief valve 120. The relief valve 120 opens when an oil pressure in the oil path 110 becomes not smaller than a predetermined value, to return lubricant oil inside the oil path 110 to the oil pan 18. Referring to FIG. 15 and FIG. 16, the oil strainer 102, the through-hole 100, the oil pump 96, the oil path 110 and the relief valve 120 are disposed on a straight line in a plan view. This makes it possible to decrease the resistance of lubricant oil flowing through the oil path 110.

Returning to FIG. 2 and FIG. 4, the cylinder 14 includes a cylinder body 122, a cylinder head 124 and a cylinder head cover 126. The cylinder 16 includes a cylinder body 128, a cylinder head 130 and a cylinder head cover 132. Referring to FIG. 8 and FIG. 9, the cylinder bodies 122, 128 are preferably formed integrally with the crankcase 12. Each of the cylinder bodies 122, 128 includes fins 134, 136 on its outer circumference.

Figure 17:
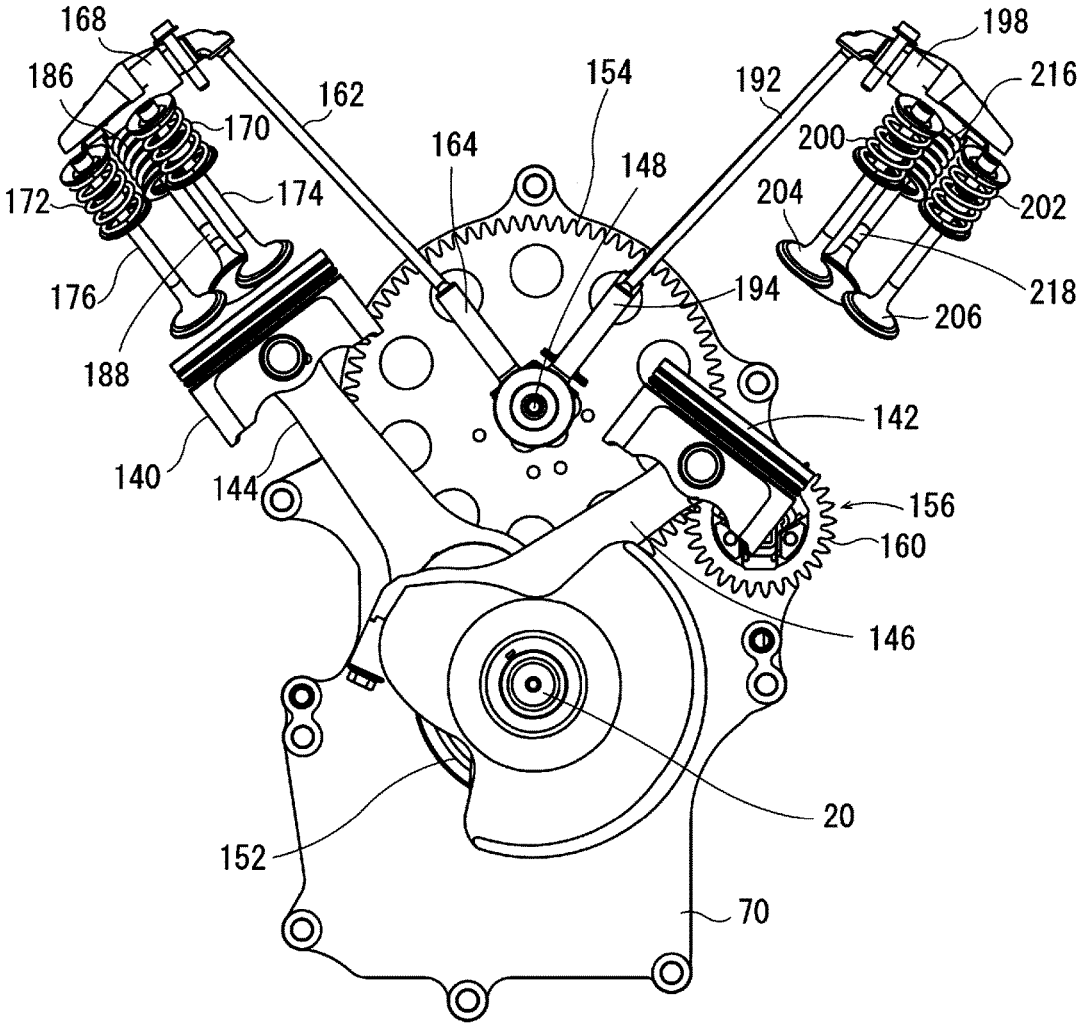
FIG. 17 is a plan view showing the crank shaft, pistons and their surroundings.
Figure 18:
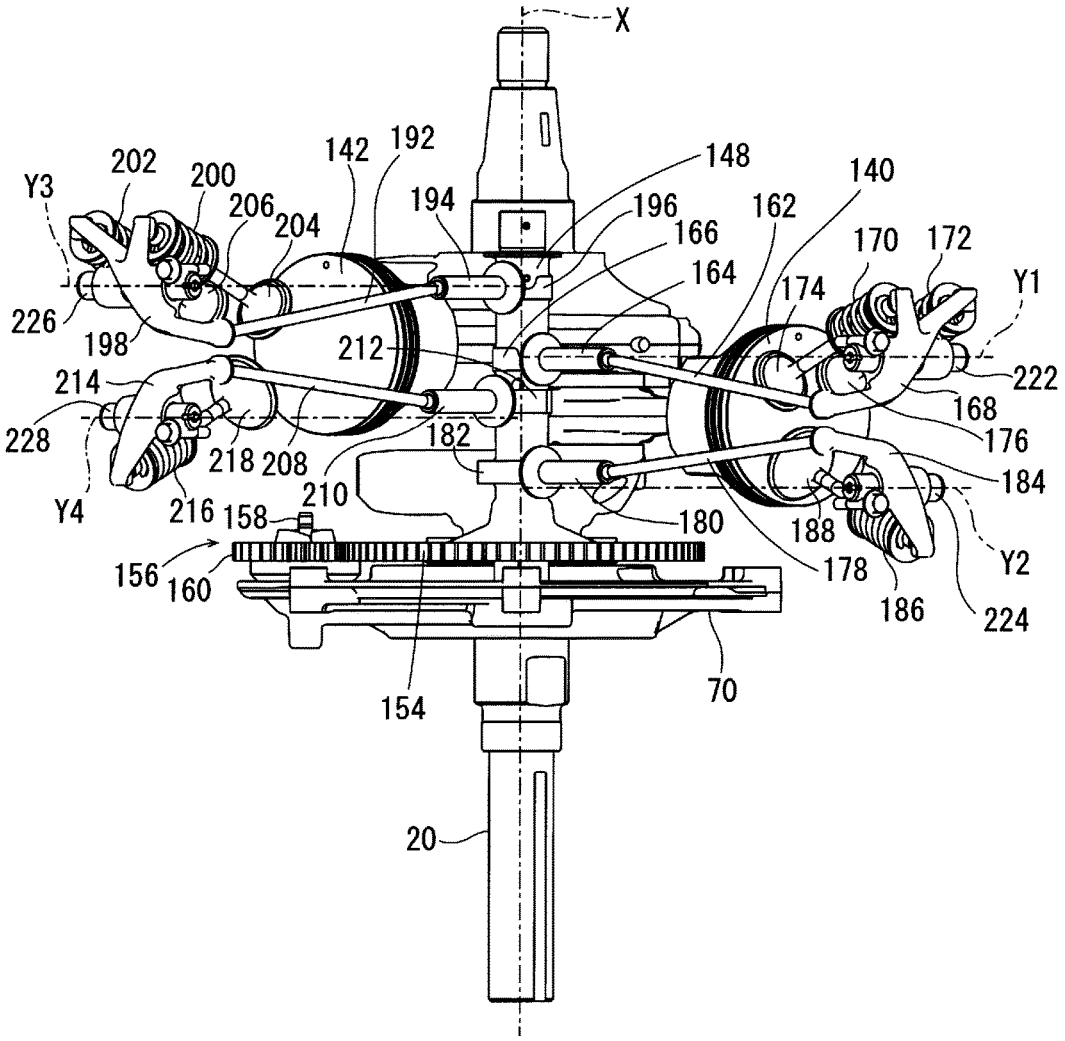
FIG. 18 is a view showing the crank shaft, the pistons and their surroundings.

Referring to FIG. 8, FIG. 9, FIG. 17 and FIG. 18, pistons 140, 142 are slidably provided inside the cylinder bodies 122, 128, respectively. Each of the pistons 140, 142 is connected by a corresponding one of connecting rods 144, 146 to the crank shaft 20 inside the crankcase 12. In the present preferred embodiment, the connecting rods 144, 146 include diagonally split connecting rods (see FIG. 20). Also in the present preferred embodiment, large end portions of the connecting rods 144, 146 are not coaxial with each other (see FIG. 17). Thus, crank pins on the crank shaft 20 are not coaxial with each other (see FIG. 7). Reciprocating movement of the pistons 140, 142 is converted into rotating movement by the crank shaft 20. Referring to FIG. 9, an arc-shaped cutout 138 is provided, near an end region of the crank shaft 20, in an inner circumferential surface in each of the cylinder bodies 122, 128. In the present preferred embodiment, the cutout 138 is coaxial with the through-hole 34 in order to avoid interference with the large end portions of the connecting rods 144, 146. The crankcase 12 incorporates the cam shaft 148 which moves together with the crank shaft 20. Referring to FIG. 7, the cam shaft 148 includes an end region supported pivotably in the bearing hole 46 by the crankcase 12 via a film of oil. Another end region of the cam shaft 148 is supported pivotably by the support 70 via a ball bearing 150 in the through-hole 78. The crank shaft 20 is provided with a driving gear 152, whereas the cam shaft 148 is provided with a driven gear 154 which rotates as the driving gear 152 rotates. Referring to FIG. 17 and FIG. 18, a governor 156 is provided inside the crankcase 12. The governor 156 is a structure or system that maintains the number of rotations of the engine 10 within a predetermined range even if there is load fluctuation. The governor 156 includes the governor shaft 158, which is pressed into the through-hole 80 of the support 70. The governor 156 includes a governor gear 160, which is attached pivotably to the governor shaft 158, engaged with the driven gear 154, and is rotated as the driven gear 154 rotates. The crank shaft 20, the cam shaft 148 and the governor shaft 158 which are supported by the support 70 are parallel or substantially parallel to each other.

In the respective cylinders 14, 16, from the cylinder bodies 122, 128 to the cylinder heads 124, 130, communication paths (not illustrated) provide communication between the inside of the crankcase 12 and rocker arm chambers (not illustrated) inside the cylinder head covers 126, 132.

Referring to FIG. 17 and FIG. 18, in the cylinder 14, a push rod 162 and a tappet 164 provided in an end region of the push rod 162 are inserted into the communication path. The tappet 164 includes a tip portion in contact with an air intake cam 166 of the cam shaft 148 inside the crankcase 12.

The push rod 162 includes another end region, which is connected to a rocker arm 168, provided inside the rocker arm chamber. Air intake valves 174, 176, which are constantly urged by valve springs 170, 172 in a closing direction, are driven by the rocker arm 168. The air intake valves 174, 176 open/close two air intake ports (not illustrated). Also, a push rod 178 and a tappet 180 provided at an end region of the push rod 178 are inserted into the communication path. The tappet 180 includes a tip portion in contact with an exhaust cam 182 of the cam shaft 148 inside the crankcase 12. The push rod 178 includes another end region, which is connected to a rocker arm 184, provided inside the rocker arm chamber. An exhaust valve 188, which is constantly urged by a valve spring 186 in a closing direction, is driven by the rocker arm 184. The exhaust valve 188 opens/closes an exhaust port 190 (see FIG. 4, FIG. 13).

Likewise, in the cylinder 16, a push rod 192 and a tappet 194 provided at an end region of the push rod 192 are inserted into the communication path. The tappet 194 includes a tip portion in contact with an air intake cam 196 of the cam shaft 148 inside the crankcase 12. The push rod 192 includes another end region, which is connected to a rocker arm 198, provided inside the rocker arm chamber. Air intake valves 204, 206, which are constantly urged by valve springs 200, 202 in a closing direction, are driven by the rocker arm 198. The air intake valves 204, 206 open/close two air intake ports (not illustrated). Also, a push rod 208 and a tappet 210 provided at an end region of the push rod 208 are inserted into the communication path. The tappet 210 includes a tip portion in contact with an exhaust cam 212 of the cam shaft 148 inside the crankcase 12. The push rod 208 includes another end region, which is connected to a rocker arm 214, inside the rocker arm chamber. An exhaust valve 218, which is constantly urged by a valve spring 216 in a closing direction, is driven by the rocker arm 214. The exhaust valve 218 opens/closes an exhaust port 220 (see FIG. 4, FIG. 13).

As will be understood from alternate long and short dash lines X, Y1, Y2, Y3, Y4 shown in FIG. 18, the cam shaft 148 is perpendicular or substantially perpendicular to rocker shafts 222, 224, 226, 228 of the rocker arms 168, 184, 198, 214 in a side view. This makes it possible to reduce an increase in friction in a valve driving mechanism, which includes a plurality of air intake valves 174, 176, and in a valve driving mechanism, which includes a plurality of air intake valves 204, 206, caused by an increase in the number of valves.

Figure 19:
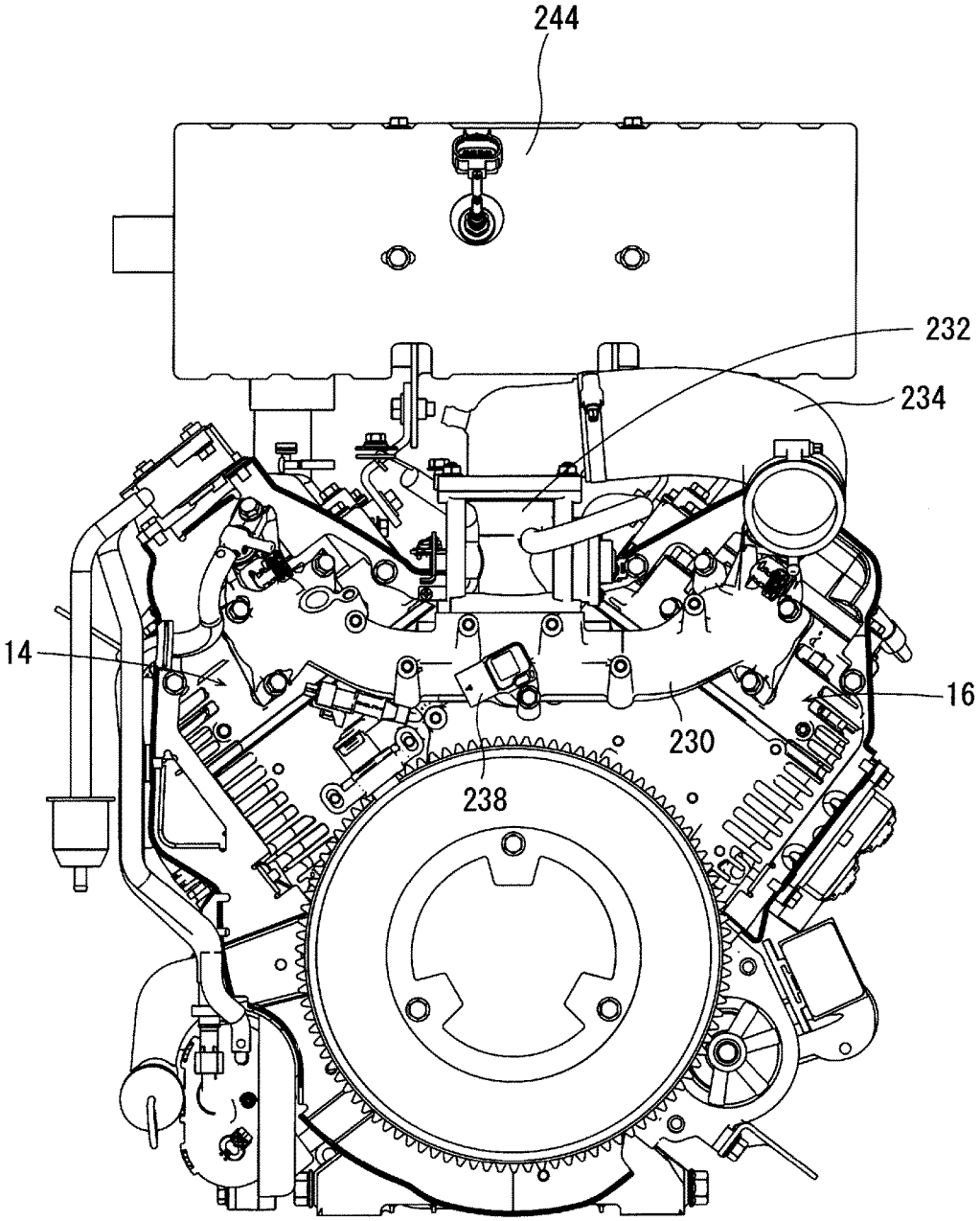
FIG. 19 is a plan view showing the engine with a cover portion removed.

Referring to FIG. 19, the air intake ports of the cylinder 14 and the air intake ports of the cylinder 16 are connected to each other by an air intake manifold 230. The air intake manifold 230 is connected to a throttle body 232. The throttle body 232 is disposed between the cylinders 14, 16 which are arranged in a narrow-angle, two-cylinder, V-shape style. To the throttle body 232, an air filter 236 is attached via an air intake pipe 234 (see FIG. 1, FIG. 2). A pressure/temperature sensor 238 is provided at a branch section where the air intake manifold 230 branches toward the two cylinders 14, 16. In other words, the pressure/temperature sensor 238 is disposed at a center portion of a cylinder-to-cylinder region of the air intake manifold 230 which connects the air intake ports of the cylinder 14 and the air intake ports of the cylinder 16 (i.e., between the air intake ports of the two cylinders). The pressure/temperature sensor 238 detects pressures and temperatures of intake air for fuel injection control. Based on outputs from the pressure/temperature sensor 238, it is possible to detect an amount of air flow.

Figure 20:
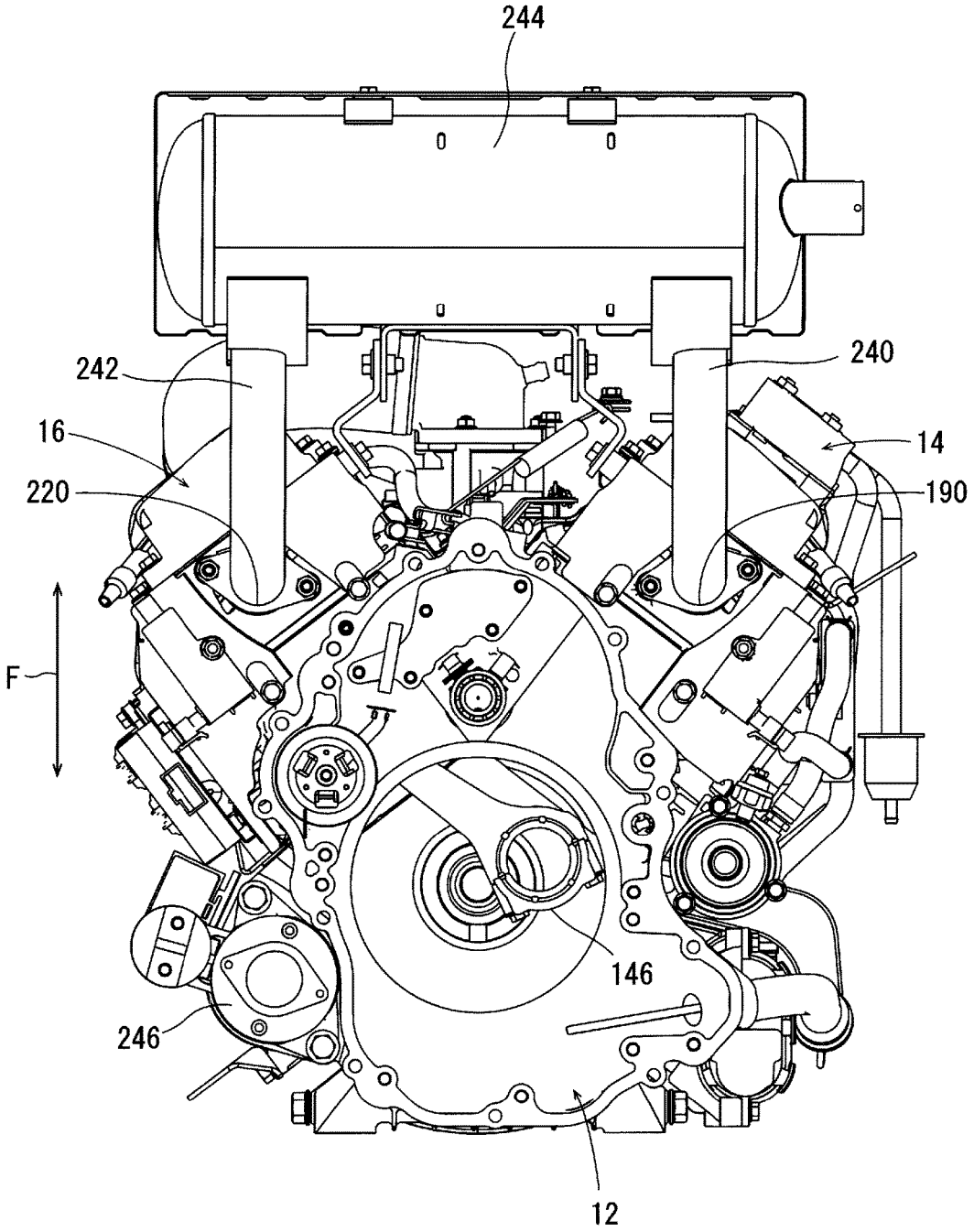
FIG. 20 is a bottom view showing the engine with the oil pan, the support and the crank shaft removed.

Referring to FIG. 20, the exhaust ports 190, 220 of the cylinders 14, 16 are connected to a muffler 244 via exhaust pipes 240, 242 respectively. Exhaust gas from the engine 10 is discharged outside via the muffler 244. The engine 10 is supplied with fuel from an unillustrated fuel tank. A starter motor 246 rotates the crank shaft 20 to start the engine 10.

In the engine 10, the support 70 preferably has a plate-shape and therefore defines a lid member for the oil pan 18 and prevents lubricant oil inside the oil pan 18 from moving upward beyond the support 70. Even if the engine 10 is tilted, for example, causing the lubricant oil to move from below to above the support 70, the lubricant oil which has moved upward beyond the support 70 returns to the oil pan 18 since the crankcase 12 and the oil pan 18 communicate with each other. Lubricant oil which has circulated inside the engine 10 and flows down from a higher position than the support 70 also returns to the oil pan 18. Therefore, it is possible to cause the lubricant oil to be near the oil strainer 102 inside the oil pan 18, and to stably supply lubricant oil from the oil strainer 102 to the oil pump 96. Also, the support 70 which supports the crank shaft 12 has its both surfaces covered by the crankcase 12 and the oil pan 18. This makes it possible to reduce noise, which is caused by vibrations from the crank shaft 20, from escaping to the outside.

Since one support 70 supports the crank shaft 20, the cam shaft 148 and the governor shaft 158, it is possible to improve the accuracy in the center-to-center distance between the crank shaft 20, the cam shaft 148 and the governor shaft 158.

Since the oil pump 96 is inside the oil pan 18, a height difference between the oil pump 96 and the oil strainer 102 is small (approximately zero in the present preferred embodiment). This makes it possible to decrease suction resistance in the oil pump 96.

The support 70 is incorporated inside the crankcase 12 and the oil pan 18, i.e., is not exposed outside of the crankcase 12 or the oil pan 18. This makes it possible to confine noise, which is caused by vibrations conducted from the crank shaft 20 to the support 70, within the crankcase 12 and the oil pan 18, and to further decrease noise.

The crank shaft 20 is supported pivotably by the support 70 which is attached to the crankcase 12, and by the crankcase 12. This makes it possible to decrease vibrations of the crank shaft 20 compared to an arrangement where the support 70 is attached to the oil pan 18.

The support 70 includes the ribs 84 which are provided at the axial center of the crank shaft 20 and radially extend toward the mounts 82. This makes it possible to improve the strength of the support 70, making it easy to dissipate loads applied from the crank shaft 20 to the support 70, to the crankcase 12 or the oil pan 18 along the ribs 84.

The ball bearing 88 is provided between the support 70 and an outer surface of the crank shaft 20. By supporting the crank shaft 20 with the ball bearing 88, the arrangement provides an appropriate solution to receive not only radial loads applied to the crank shaft 20 but also thrust loads applied thereto.

The connecting rods 144, 146 include diagonally split connecting rods (see FIG. 20), and each of the cylinder bodies 122, 128 includes the cutout 138 (see FIG. 9). This makes it possible to decrease a dimension of the crankcase 12, and consequently a dimension of the engine 10 in its fore-aft direction (in the direction indicated by Arrow F in FIG. 20).

It should be noted here that the support 70 may be positioned in the oil pan 18 inside the crankcase 12 and the oil pan 18, with a gap provided between the outer circumference of the support 70 and the end edge 90 of the oil pan 18. In this arrangement, the mounts 82 of the support 70 are attached to the oil pan 18.

Also, a carburetor may be disposed between the cylinders 14, 16 of the narrow-angle V-shaped two-cylinder engine.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An engine comprising:

a crankcase including a downward opening;

an oil pan provided below the crankcase and including an upward opening;

a crank shaft provided inside the crankcase and the oil pan such that a crank shaft axis extends in an up-down direction and the crank shaft penetrates the crankcase and the oil pan;

an oil pump coaxial with the crank shaft and driven by the crank shaft;

an oil strainer provided inside the oil pan; and a plate-shaped support pivotably supporting a first region of the crank shaft; wherein the support is disposed in at least one of the crankcase and the oil pan such that both surfaces of the support are covered by the crankcase and the oil pan and allows communication between the crankcase and the oil pan.

2. The engine according to claim 1, further comprising a cam shaft parallel or substantially parallel to the crank shaft and located inside the crankcase; wherein the support pivotably supports the crank shaft and the cam shaft.

3. The engine according to claim 2, further comprising a governor shaft parallel or substantially parallel to the crank shaft and located inside the crankcase;

wherein the support supports the crank shaft, the cam shaft, and the governor shaft.

4. The engine according to claim 1, wherein the oil pump is inside the oil pan.

5. The engine according to claim 1, wherein the support includes a perimeter edge region including mounts attached to at least one of the crankcase and the oil pan to mount the support inside the crankcase and the oil pan.

6. The engine according to claim 5, wherein the mounts are attached to the crankcase, and the crankcase pivotably supports a second region of the crank shaft.

7. The engine according to claim 5, wherein the support includes ribs centered at an axial center of the crank shaft and extending radially toward the mounts.

8. The engine according to claim 1, further comprising a ball bearing disposed between the support and an outer surface of the crank shaft.

* * * * *